US008316477B2

(12) United States Patent
Smith et al.

(10) Patent No.: US 8,316,477 B2
(45) Date of Patent: Nov. 27, 2012

(54) CARTRIDGE ASSEMBLY FOR A SELF-CONTAINED EMERGENCY EYEWASH STATION

(75) Inventors: Daniel P Smith, Portsmouth, RI (US); Benoit Devinat, Providence, RI (US); Michael C. Pereira, Smithfield, RI (US)

(73) Assignee: Sperian Eye & Face Protection, Inc., Smithfield, RI (US)

( * ) Notice: Subject to any disclaimer, the term of this patent is extended or adjusted under 35 U.S.C. 154(b) by 1414 days.

(21) Appl. No.: 11/551,948

(22) Filed: Oct. 23, 2006

(65) Prior Publication Data

US 2007/0089232 A1 Apr. 26, 2007

Related U.S. Application Data

(60) Provisional application No. 60/729,639, filed on Oct. 24, 2005.

(51) Int. Cl.
*A61H 33/04* (2006.01)

(52) U.S. Cl. ..... 4/620

(58) Field of Classification Search ..... 4/616, 617, 4/619, 620; 604/294, 295
See application file for complete search history.

(56) References Cited

U.S. PATENT DOCUMENTS

| | | | |
|---|---|---|---|
| 29,466 | A | 8/1860 | Ender |
| 1,638,159 | A | 8/1927 | Hopewell |
| 2,910,064 | A | 10/1959 | Brangaitis |
| 2,999,248 | A | 9/1961 | Logan et al. |
| 2,999,249 | A | 9/1961 | Logan et al. |
| 3,035,737 | A | 5/1962 | Speas |
| 3,106,722 | A | 10/1963 | Logan et al. |
| 3,871,554 | A | 3/1975 | Huck |
| 3,904,083 | A | 9/1975 | Little |
| 4,012,798 | A | 3/1977 | Liautaud |
| D250,594 | S | 12/1978 | Gardner |
| 4,131,115 | A | 12/1978 | Peng |
| 4,232,671 | A | 11/1980 | Crump |
| 4,363,146 | A | 12/1982 | Liautaud |
| 4,493,119 | A | 1/1985 | Baumann |
| 4,527,716 | A | 7/1985 | Haas et al. |
| 4,641,384 | A | 2/1987 | Landsberger et al. |
| 4,675,924 | A | 6/1987 | Allison et al. |
| 4,688,276 | A | 8/1987 | Allison et al. |
| 4,750,643 | A | 6/1988 | Wortrich |

(Continued)

FOREIGN PATENT DOCUMENTS

| | | |
|---|---|---|
| CN | 1625382 | 6/2006 |

(Continued)

OTHER PUBLICATIONS

All Safety Products, Inc., "www.allsafetyprocuts.biz", Gravity Fed Eye Wash Station.

(Continued)

*Primary Examiner* — Tuan N Nguyen
(74) *Attorney, Agent, or Firm* — Barlow, Josephs & Holmes, Ltd.

(57) ABSTRACT

A cartridge for an emergency eyewash stations is disclosed. The cartridge assembly includes a housing having a front section and a back section that couple together. The front section has a surface defining an opening into the housing. A sealed, fluid-containing bladder having a dispensing port is contained within the housing. A bracket is configured and arranged to couple to the opening on the front section of the housing such that the dispensing port is captured in a fixed position between the bracket and the surface on the front section defining the opening.

8 Claims, 8 Drawing Sheets

U.S. PATENT DOCUMENTS

| | | | |
|---|---|---|---|
| 4,758,237 | A | 7/1988 | Sacks |
| 4,769,863 | A | 9/1988 | Tegg et al. |
| 4,784,652 | A | 11/1988 | Wikstrom |
| 4,881,283 | A | 11/1989 | Liautaud |
| 4,928,697 | A | 5/1990 | Hsu |
| 4,938,421 | A | 7/1990 | Berfield et al. |
| 4,939,800 | A | 7/1990 | Fiorentino et al. |
| 4,998,850 | A | 3/1991 | Crowell |
| 5,008,963 | A | 4/1991 | Stein |
| 5,046,648 | A | 9/1991 | Herbstzuber |
| 5,150,811 | A | 9/1992 | Kelston |
| 5,157,798 | A | 10/1992 | Van Kammen |
| 5,170,518 | A | 12/1992 | Warriner |
| 5,171,306 | A | 12/1992 | Vo |
| 5,195,655 | A | 3/1993 | Bukhman |
| 5,201,726 | A | 4/1993 | Kirkham |
| 5,216,765 | A | 6/1993 | Paterson et al. |
| 5,230,109 | A | 7/1993 | Zaccai et al. |
| D342,309 | S | 12/1993 | Paterson et al. |
| 5,320,615 | A | 6/1994 | Van Keuren |
| 5,334,180 | A | 8/1994 | Adolf et al. |
| 5,381,567 | A | 1/1995 | Tanner et al. |
| 5,401,259 | A | 3/1995 | Py |
| 5,530,972 | A | 7/1996 | Tanner |
| 5,531,707 | A | 7/1996 | Kers |
| 5,566,406 | A | 10/1996 | Demeny et al. |
| 5,607,410 | A | 3/1997 | Branch |
| 5,634,458 | A | 6/1997 | Joshi et al. |
| 5,678,255 | A | 10/1997 | Stoudamire, Sr. |
| 5,687,434 | A | 11/1997 | Tagg |
| 5,695,124 | A | 12/1997 | Demeny et al. |
| 5,732,853 | A | 3/1998 | Ganzeboom et al. |
| 5,740,569 | A | 4/1998 | Gurries, II et al. |
| 5,754,900 | A | 5/1998 | Suda |
| 5,791,519 | A | 8/1998 | Van Marcke |
| 5,850,641 | A | 12/1998 | Demeny et al. |
| 5,967,197 | A | 10/1999 | Shown |
| 6,029,293 | A | 2/2000 | Paterson et al. |
| 6,070,279 | A | 6/2000 | Lundstedt |
| 6,098,844 | A | 8/2000 | Nicolle |
| 6,131,766 | A | 10/2000 | King et al. |
| 6,142,344 | A | 11/2000 | Kai |
| 6,161,228 | A | 12/2000 | Wietecha |
| 6,186,361 | B1 | 2/2001 | Teetsel, III |
| D438,983 | S | 3/2001 | Stein |
| 6,205,599 | B1 | 3/2001 | Anders |
| 6,270,014 | B1 | 8/2001 | Bollas et al. |
| 6,296,626 | B1 | 10/2001 | Stein |
| 6,385,794 | B1 | 5/2002 | Miedzius et al. |
| 6,398,766 | B1 | 6/2002 | Branch |
| 6,432,078 | B1 | 8/2002 | Peyman |
| 6,458,108 | B1 | 10/2002 | Tangri |
| D466,589 | S | 12/2002 | Miedzius |
| 6,510,965 | B1 | 1/2003 | Decottignies et al. |
| 6,520,431 | B2 | 2/2003 | Donovan |
| 6,540,726 | B1 | 4/2003 | Follman et al. |
| 6,554,164 | B1 | 4/2003 | Jones |
| 6,561,383 | B1 | 5/2003 | Reddy et al. |
| 6,595,920 | B2 | 7/2003 | Walton |
| 6,610,036 | B2 | 8/2003 | Branch et al. |
| 6,726,061 | B2 | 4/2004 | Good |
| 6,758,837 | B2 | 7/2004 | Peclat et al. |
| 6,782,568 | B2 | 8/2004 | Novak et al. |
| 6,913,598 | B2 | 7/2005 | Tangri |
| 2001/0052681 | A1 | 12/2001 | Deavila |
| 2003/0032930 | A1 | 2/2003 | Branch |
| 2003/0208186 | A1 | 11/2003 | Moreyra |
| 2004/0124211 | A1 | 7/2004 | Jones |
| 2004/0204674 | A1 | 10/2004 | Andeson et al. |
| 2004/0244106 | A1 | 12/2004 | Chesters |
| 2005/0054992 | A1 | 3/2005 | Madritsch et al. |
| 2005/0077318 | A1 | 4/2005 | Macler et al. |
| 2005/0217019 | A1 | 10/2005 | Johnson et al. |

FOREIGN PATENT DOCUMENTS

| | | | |
|---|---|---|---|
| EP | 0083782 | B1 | 6/1987 |
| EP | 0723769 | B1 | 7/2001 |
| FR | 2625098 | | 6/1989 |
| GB | 1460064 | | 12/1976 |
| GB | 2157569 | A | 10/1985 |
| JP | 08289916 | | 11/1996 |
| JP | 10151148 | | 6/1998 |
| JP | 2001079061 | | 3/2001 |
| WO | 8702237 | | 4/1987 |
| WO | 8705498 | | 9/1987 |
| WO | 9619177 | | 6/1996 |
| WO | 03065967 | A1 | 8/2003 |

OTHER PUBLICATIONS

PlumberSurplus, "www.plumbersurplus.com", Speakman SE-577-SD Emergency Safety Equipment Eyewash Station.

Ramsey Group, "www.ramsey-group.com/pureflow1000.html", Fend-All Pure Flow 1000 Emergency Eyewash Station (FEN-1000).

First Aid Supplies & Safety Products, "www.firstaidandsafetyonline.com/showproduct-catid-24.asp", Eyewash Station, Bradley Eyewash Stations, Emergency Eyewash Station, Portable Eyewash.

CARTRIDGE ASSEMBLY FOR A SELF-CONTAINED EMERGENCY EYEWASH STATION

CROSS-REFERENCE TO RELATED APPLICATION

This application claims priority to earlier filed U.S. Provisional Application No. 60/729,639, filed on Oct. 24, 2005, the contents of which are incorporated herein by reference.

BACKGROUND OF THE INVENTION

1. Field of the Invention

The present invention relates generally to self-contained emergency eyewash stations and more particularly to an improved cartridge assembly containing a "sterile" eyewash fluid for such stations.

2. Background of the Related Art

Government and employers are increasingly aware of the need for protecting the health and safety of workers. For this reason, it is common to find eye wash fountains at industrial work sites, laboratories, and other locations where workers are exposed to gaseous fumes, liquids or solid materials which can irritate or injure eyes upon contact therewith. The Occupational Safety and Health Administration (OSHA) has made eye wash fountains mandatory for particular industrial work stations.

Early installations of eye wash fountains employed sprays of regular tap water fed from regular plant plumbing connections. These devices were adequate for a period of time, but suffered from the drawbacks of using the regular water supply. For example, there could be contaminants and bacteria in regular plumbed water. Furthermore, the pressure of regular running water is inconsistent creating an uneven water flow, or in the event of a major facility accident, the water may not be running at all.

Later devices, such as the eye wash fountains disclosed in U.S. Pat. No. 4,012,798 to Liautaud and U.S. Pat. No. 4,363,146 to Liautaud, were self-contained, gravity-fed, and independent of any plumbing connections. These self-contained eye wash fountains typically included a reservoir (or bottle)s of wash fluid spaced above two opposed liquid spray nozzles. Upon activating the fluid flow, the wash fluid from the reservoir is fed solely by gravity to the nozzles to cause a gravity-induced spray of wash fluid from the nozzles. These stations provided improved safety in terms of the quality of the water utilized but suffered from low and/or inconsistent water pressure to properly flush the eyes.

In an effort to encourage more suitable eye wash facilities, the American National Standards Institute (ANSI) promulgated voluntary standards for portable eye wash fountains relating to flushing periods and the rate of flow of wash fluid. These standards dictate that portable eye wash fountains should deliver no less than 0.4 gallons per minute (1.5 liters per minute) of eye wash fluid for a time period of 15 minutes. Responsive to the new ANSI standard, several designs emerged that included means for maintaining a constant eye wash flow rate without any powered pumping mechanisms. For example, U.S. Pat. No. 5,566,406, U.S. Pat. No. 5,695,124 and U.S. Pat. No. 5,850,641 all issued to Demeny et al, disclose an emergency eyewash station having a gravity assist mechanism that acts on a flexible reservoir contained in a disposable paperboard box. The self-contained emergency eye wash station generally comprises a housing, a reservoir, and a platen. The housing includes a shelf that supports a pair of flexible containers arranged in side-by-side relation. The flexible containers are of the type generally referred to as "bag-in-a-box" packaging, having an inner flexible plastic bag containing the eyewash fluid, and an outer cardboard box structure, which supports the flexible bag in a predetermined shape. The housing further supports a delivery platform including a nozzle, which is in fluid communication with the flexible container. The nozzle selectively dispenses the eye wash fluid from the flexible container when activated. The housing further includes a drain that captures the eye wash fluid dispensed from the nozzle and directs the eye wash fluid into the reservoir. The reservoir is slidably mounted to the housing and the platen is connected to the reservoir. As the reservoir fills, the platen presses downward on the flexible container with a downward force proportional to a weight of the eye wash fluid collected in the reservoir. The transfer of the weight of the eye wash fluid collected in the reservoir to the platen maintains a constant flow of eye wash fluid dispensed from the nozzle.

The above-noted gravity assist configuration has been very successful in the marketplace and is still in widespread use today. Because the 6 gallons of fluid is divided into two smaller containers, the flexible reservoirs are relatively small and easily replaced by service personnel. In addition, the bag-in-a-box packaging technology is well established, and the costs for producing, maintaining and replacing the disposable cartridges at established intervals of time have heretofore been relatively inexpensive. The costs for this type of system are such that the manufacturer could cost effectively provide a pre-assembled delivery tube and nozzle assembly with each of the disposable cartridges, making installation and replacement that much easier.

However, new ANSI and OSHA regulations have created new issues that will need to be addressed, and will require improvements to the existing designs to maintain compliance. In particular, upcoming OSHA regulations will soon require the use of "sterile" eye wash fluids. The regulatory and production requirements for "sterile" eyewash fluids are far greater than the previous "non-sterile" standards and will make the production of the existing cartridges cost prohibitive.

Accordingly, there is a need in the industry for an improved cartridge assembly which can be filled with a sterile fluid, maintained in a sterile condition for the required shelf-life of the product, provide for safe shipment, handling and storage of the product, and provide for simple installation and replacement, and finally provide a reliable dispensing arrangement for emergency use.

SUMMARY OF THE INVENTION

The improved cartridge assembly of the present invention addresses the problems of the prior art by providing an improved "bag-in-a-box" cartridge assembly comprising a rigid plastic, outer housing and a disposable flexible inner bladder or bag containing a sterilized eyewash fluid therein.

The rigid plastic construction of the outer housing allows the flexible inner bag to be a larger size whereas, in contrast, the prior bag-in-a-box cartridges were limited in size by the strength of the outer cardboard box. The shipping of fluid products is somewhat complicated in that excess movement of the water within the containers can generate tremendous pressure within the container and can cause cardboard or paperboard containers to fail, breaking the inner bags and resulting in leakage or loss of the entire contents. Furthermore, the rupture of a single bag in a bulk shipment wets the cardboard containers of the other cartridges, weakens those cartridges and increases the chances of further ruptures. In the context of the less expensive "non-sterile" fluid products, occasional failures were tolerated. However, the significantly higher costs of the new "sterile" fluids, combined with the larger size and weight of the cartridge, warrants a higher level of protection, and hence the use of a reusable plastic housing.

The housing is formed from two symmetrically identical housing sections each having interfitting mating formations that permit the housing sections to be snap-fit together and maintained in assembled relation.

The flexible bag comprises a flexible plastic material configured for optimal displacement and capacity within the housing. The flexible bag is filled using a proprietary filling system and filling port that maintains sterility of the inside of the bag and the fluid during the filling process. The filling port includes a rigid plastic retaining collar having spaced flanges that are captured in an orifice formed between the mating halves of the housing. The filling port is thus captured in a fixed position for puncturing and dispensing of the fluid when mounted in a corresponding dispensing unit, i.e. emergency eyewash station.

The cartridge further includes a movable platen with a pair of straps connected thereto to assist the gravity feed of the eyewash fluid during the operation of the emergency eyewash station.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Figure 1:
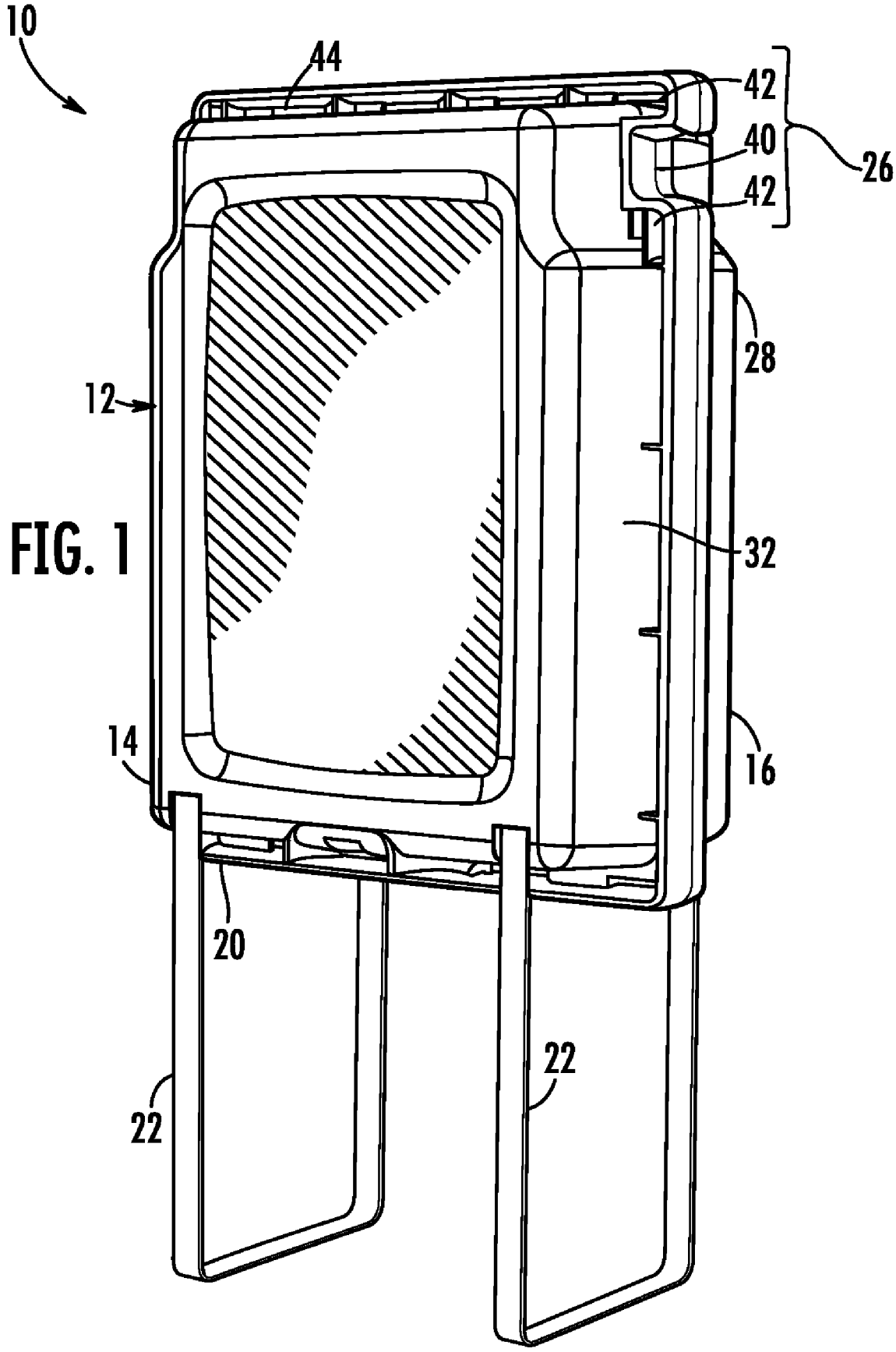
FIG. 1 is a perspective view of the preferred embodiment of the present invention.
Figure 2:
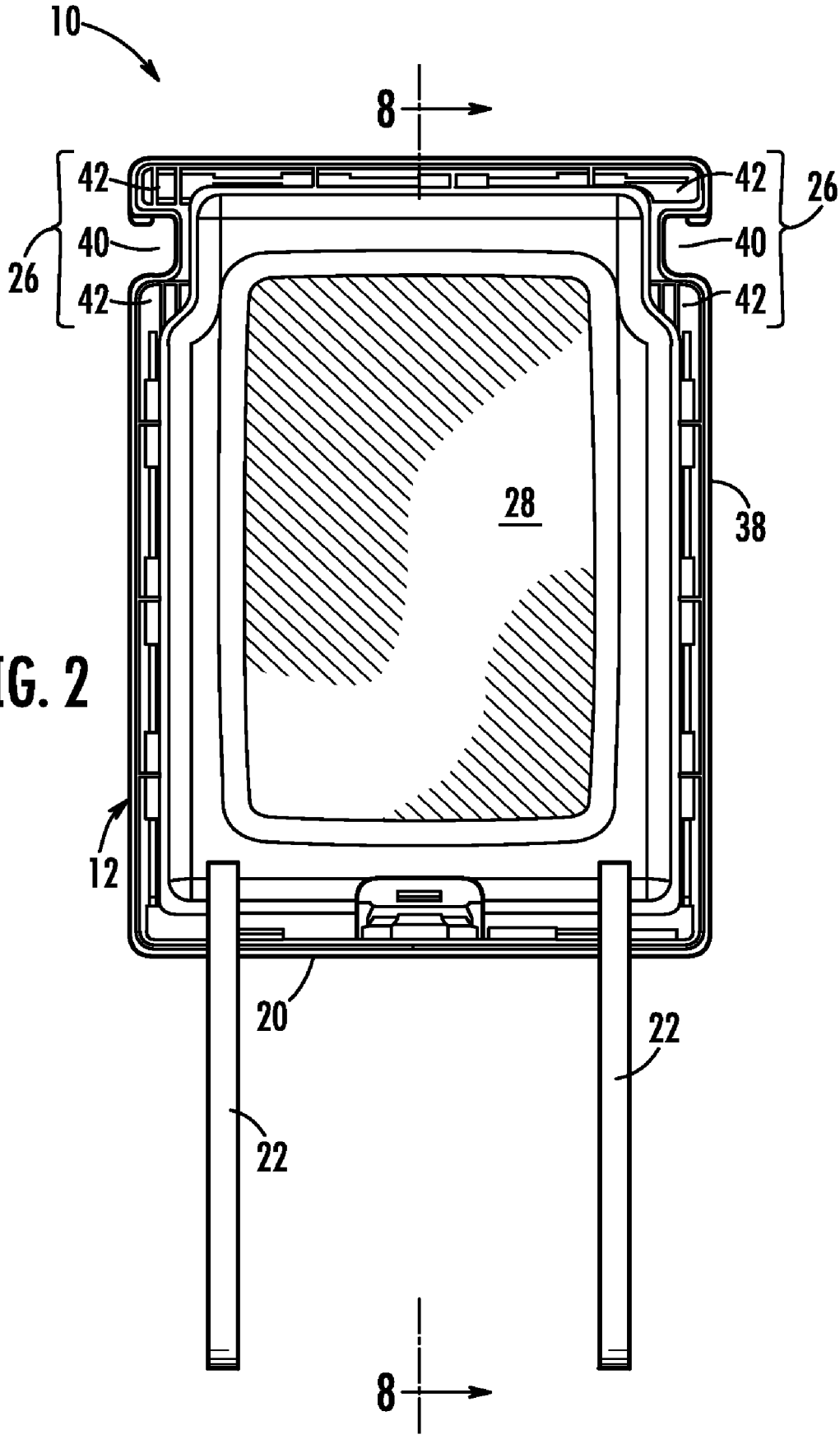
FIG. 2 is a front view of the preferred embodiment of the present invention.
Figure 6:
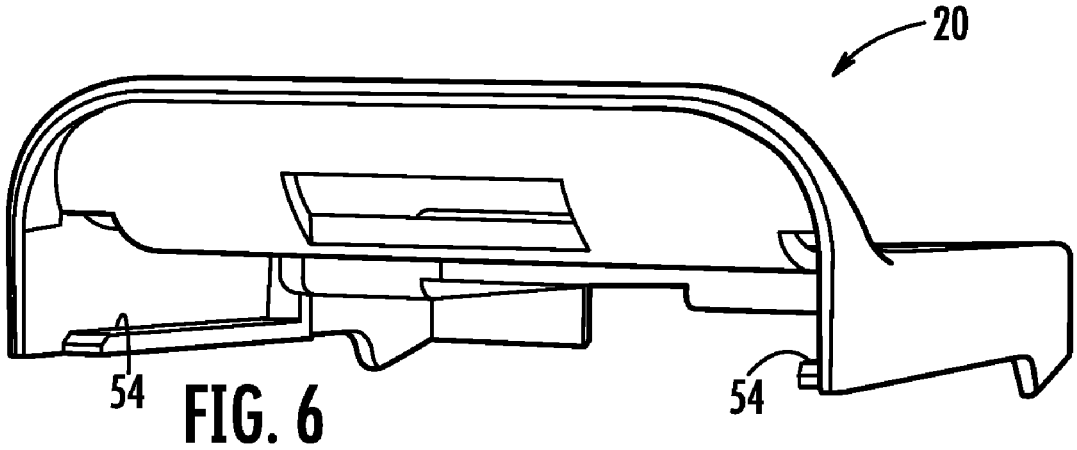
FIG. 6 is a front perspective view of the retaining bracket shown in FIG. 4.
Figure 7:
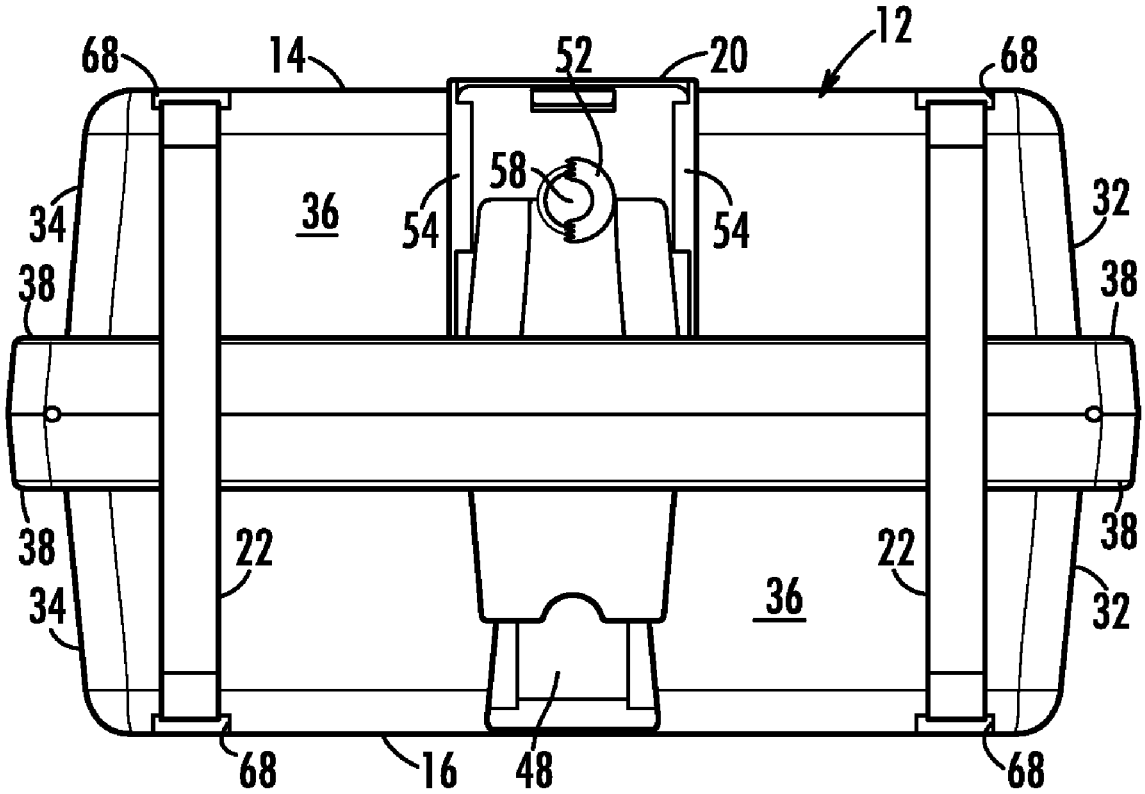
FIG. 7 is a bottom view of the preferred embodiment of the present invention.

Referring to FIGS. 1 and 2, the cartridge assembly of the present invention is shown generally at 10. As will be described in greater detail below, the cartridge assembly 10 of the present invention includes an outer housing 12 having a front section 14 and a back section 16. An inner bladder 18 containing eyewash fluid, which is best seen in FIGS. 6 and 7, is contained within the outer housing 12. The housing 12 further includes a retaining bracket 20 which cooperates with an edge of one of the housing sections to capture the fill port of the inner bladder.

In the context of using the cartridge assembly 10 in a gravity assist eyewash system similar to the prior art, the cartridge assembly 10 further includes a platen 64 positioned at the top of the housing 12, and a pair of straps 22 depending from the platen 64 and extending out of the housing 12 for engagement with a fluid collection container or reservoir (not shown).

The front and back housing sections 14 and 16 are preferably molded from a rigid plastic material. Other rigid material having similar structural capabilities could also be utilized.

The front section 14 and back section 16 of the outer housing 12 are box-shaped having an upper end and a lower end. Other shapes could also be used. Preferably, the front and back sections 14, 16 are symmetrical mirror images of each other and thus interchangeable. The upper end is slightly narrower than the lower end to facilitate the formation of hanging brackets 26, which will be described more fully below. Each of the sections 14, 16 has a main panel 28 with four depending sidewalls (top 30, left 32, right 34 and bottom 36) depending therefrom. Each sidewall 30, 32, 34, 36 is connected to the adjacent sidewall to form the box shape. The outer-most edge of the depending sidewalls 30, 32, 34, 36 is turned outwardly away from each respective sidewall and then inwardly towards the main panel 28 to form a rim 38. Near the upper end of each section and along the rim is a U-shaped section 40 that forms a hanging bracket. The U-shaped section 40 is formed by two sections 42 of the rim 28 extending therefrom near the narrow end of each section 14, 16.

The front and back sections 14, 16 are preferably snap-fit together with a number of reciprocal mating formations 44 aligned along the rims 28 of the front and rear sections 14, 16. These mating formations 44 can best be seen in FIG. 3, it being understood that the mating formations 44 are reciprocal to both sections 14, 16 of the outer housing 12 to facilitate the interlocking thereof. Although this configuration is preferred, many other structures can be used to retain the sections 14, 16 of the outer housing 12 together and the preferred embodiment is by way of example and not a limitation of the present invention.

Figure 5:
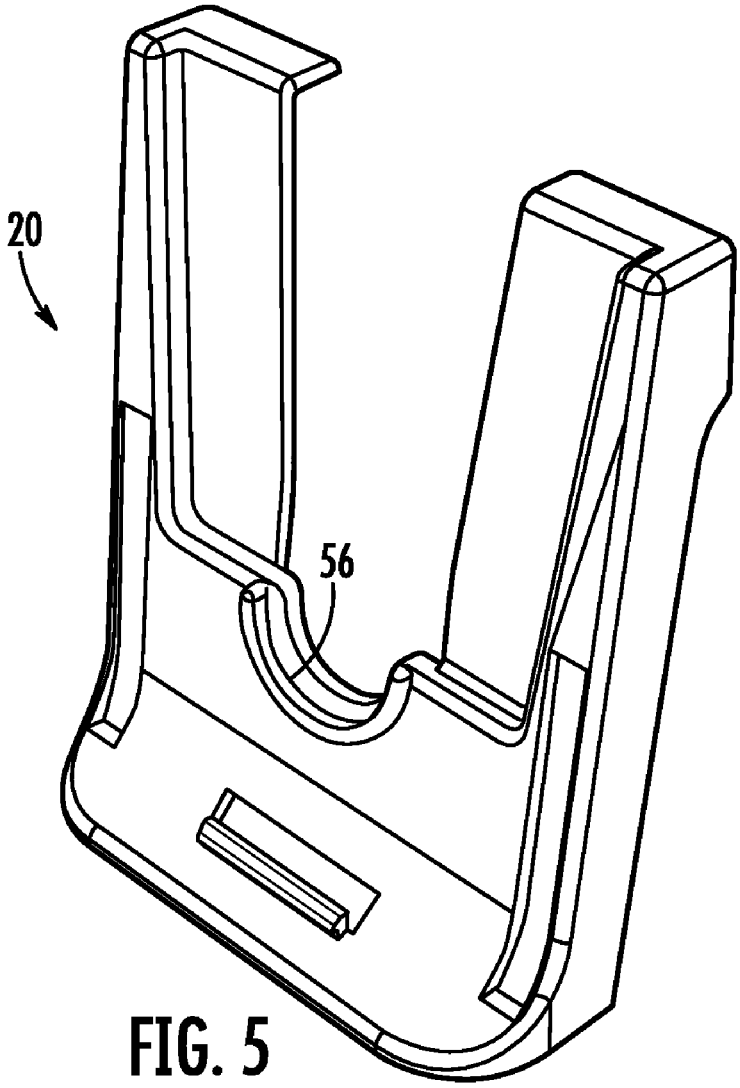
FIG. 5 is a top perspective view of the retaining bracket of the present invention.

Referring to FIG. 7, the bottom sidewalls 36 of the front and back sections 14, 16 of the outer housing 12 have an opening 46 formed therein with a semi-circle shaped edge 48. The retaining bracket 20, best seen in FIGS. 5 and 6, cooperates with the opening 48 to form a circular orifice 50 in the outer housing 12. The orifice 50 selectively captures a flanged fill port 52 of the inner bladder 18 therebetween and holds it firmly in place (best seen in FIG. 6).

Referring back to FIGS. 5 and 6, the retaining bracket 20 has mounting tabs 54 formed thereon to facilitate attachment of a dispensing apparatus (not shown) to the outer housing 12. The retaining bracket 20 also includes a semi-circular shaped lip 56 that cooperates with the opening 48 to form the orifice 50.

Figure 3:
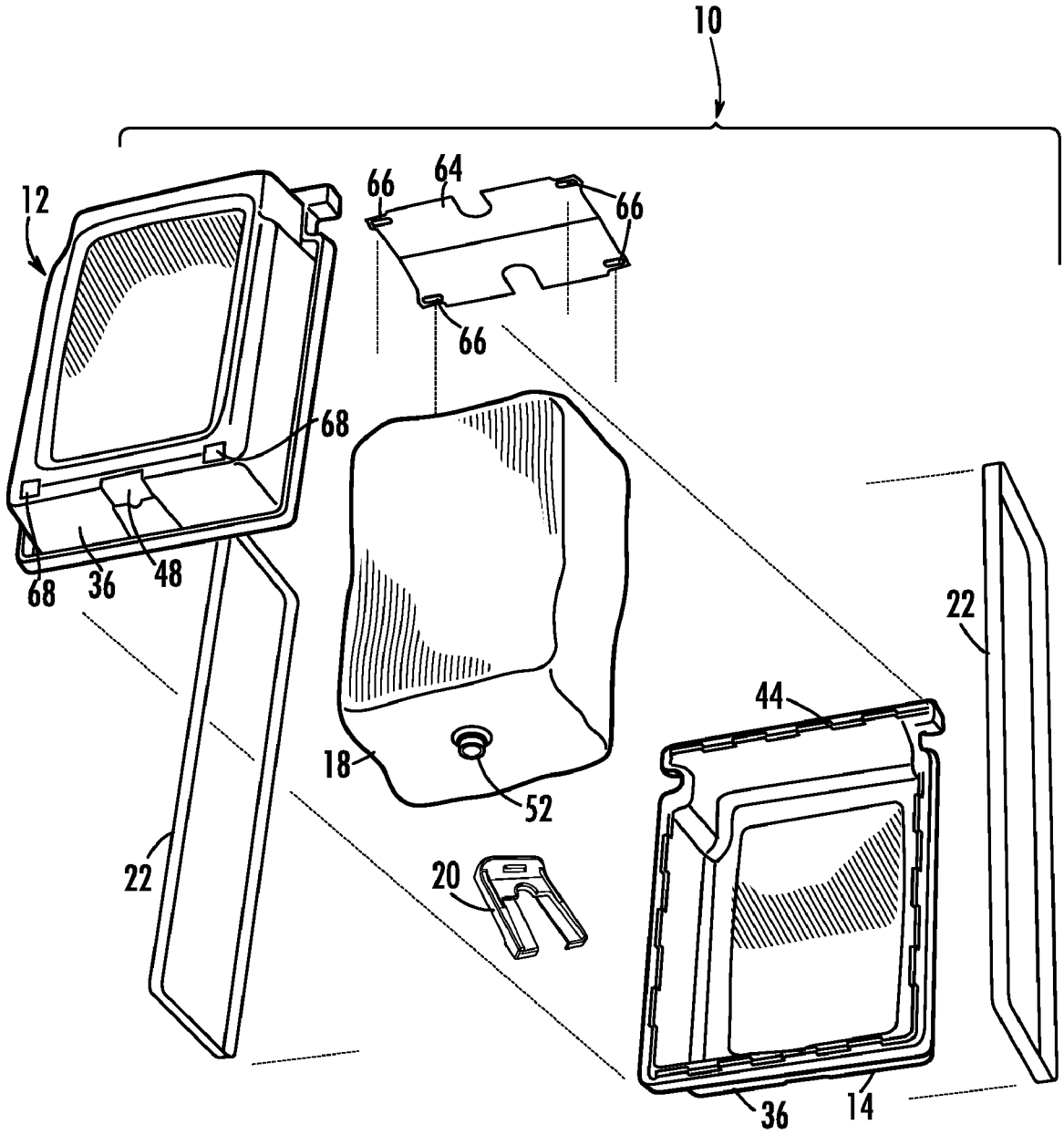
FIG. 3 is an exploded view of the preferred embodiment of the present invention.
Figure 4:
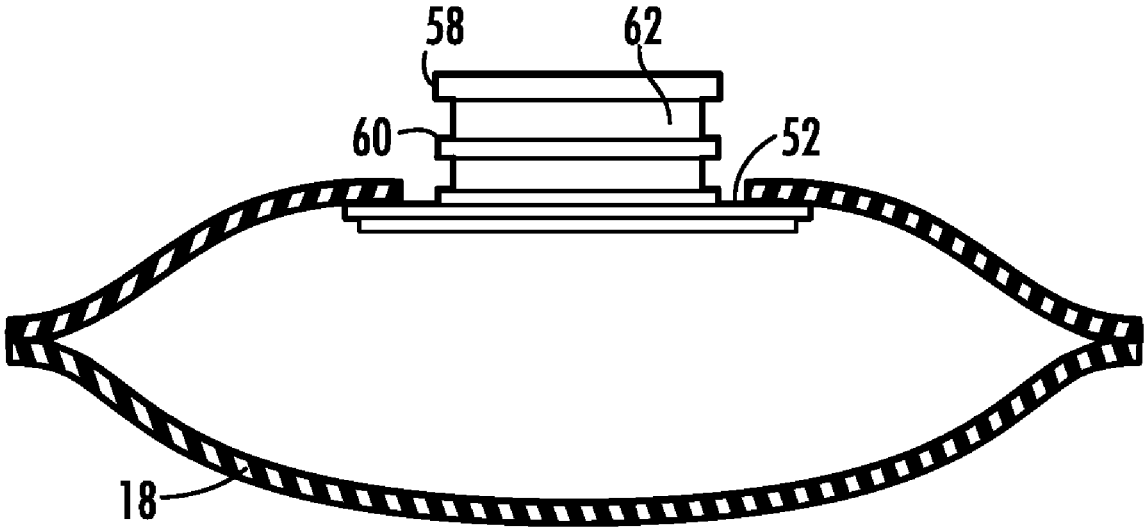
FIG. 4 is a cross-sectional view of the inner bladder and fill port.
Figure 8:
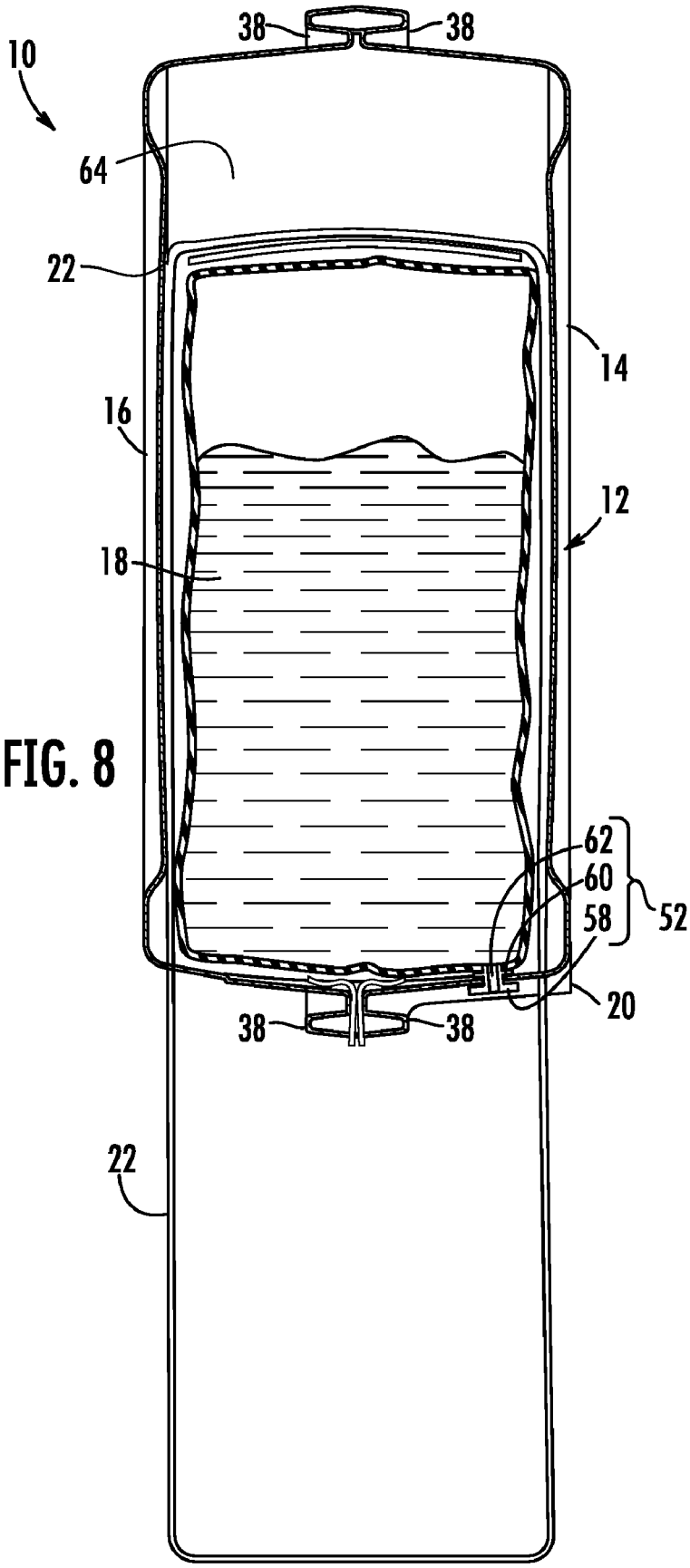
FIG. 8 is a side cross-section view through line 8-8 of FIG. 2.

Referring to FIGS. 3, 4 and 8, the inner bladder 18 fits snugly within the outer housing 12 with little room for the fluid to move within the confines of the housing 12. The inner bladder 18 has a flanged fill port 52 having an upper flange 58 and a lower flange 60 extending from a dispensing spout 62. As described briefly earlier, the upper and lower flanges 58, 60 fit within the orifice 50 thus trapping the flanged fill port 52 in a fixed position within the orifice 50. The inner bladder 18 is preferably filled with a "sterile" eyewash fluid, which one skilled in the art would be able to select according to the specifications and uses that are desired. While the specification clearly identifies the use of a sterile eyewash fluid, the invention should not be limited to the type of fluid. It is contemplated that the improved bag-in-a-box cartridge system can be used for any type of material, which could be filled within the bladder.

As briefly mentioned hereinabove, a platen 64 is positioned on top of the inner bladder 18, near the upper end of the outer clamshell casing 12. Two straps 22 loop through slots 66 in each end of the platen 64 and are threaded through slots 68 in the bottom of the outer housing 12. During operation of an eyewash station, tension may be applied to the straps 22 by collecting the dispensed fluid in a container sitting on the straps, thus pulling the platen 64 downwardly and this exerting force a downward force on the inner bladder 18 to control the flow of eyewash fluid therefrom.

It should be understood that the platen 64 and straps 22 are optional elements in the context of using the cartridge assembly in other industries and circumstances.

After activation of the cartridge assembly 10, the cartridge assembly 10 may be replaced onsite by removing the retaining bracket 20 and disassembling the halves 14, 16 of the outer housing 12. The inner bladder 18 may then be replaced with a fresh bladder and the cartridge 10 reassembled and reinstalled into the eyewash station. Alternatively, the exhausted cartridge assembly 10 may be collected and refurbished offsite.

Figure 9:
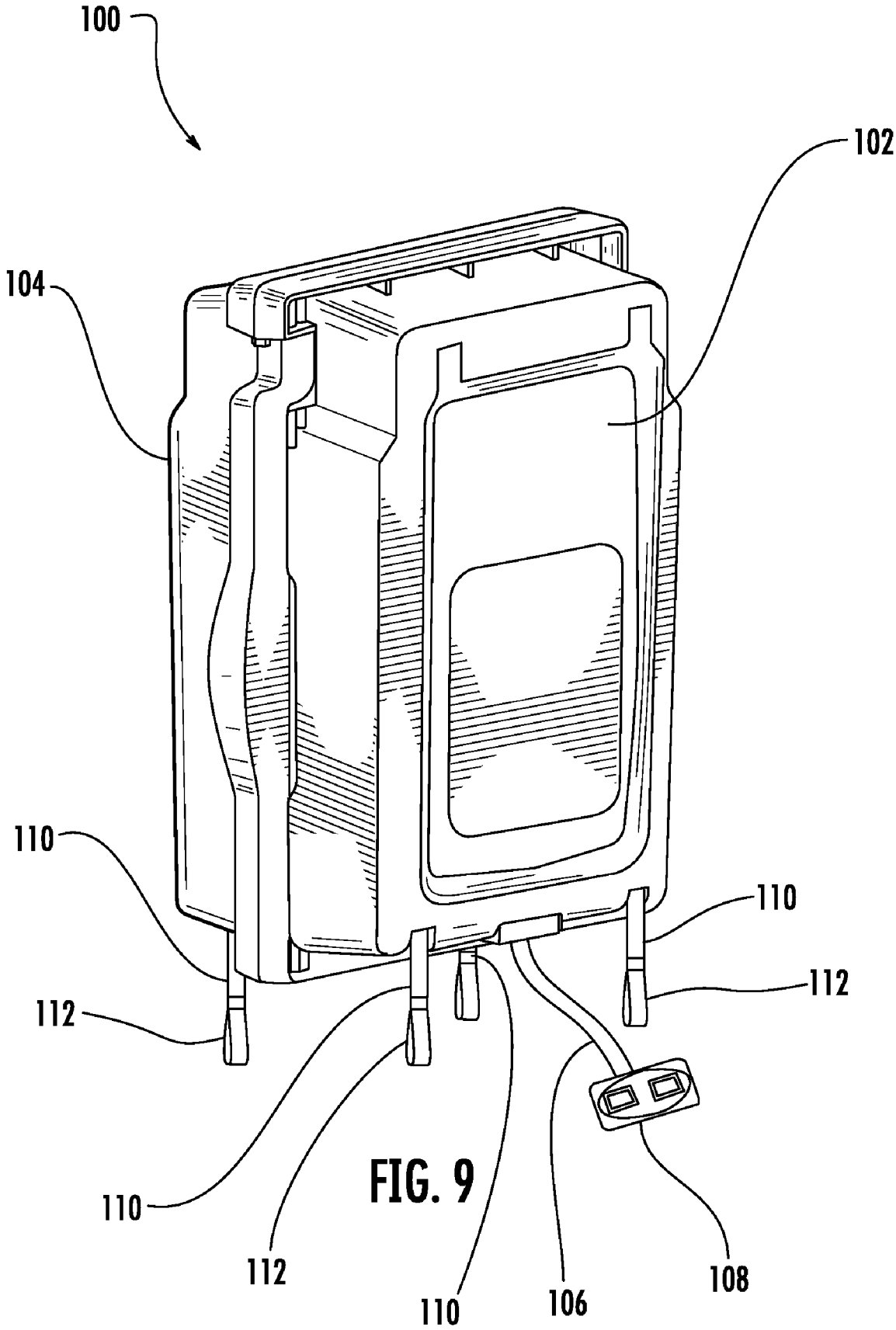
FIG. 9 is a perspective view of an alternative embodiment of the cartridge assembly of the present invention.

Referring to FIG. 9, an alternative embodiment of the cartridge assembly of the present invention is shown generally at 100. The alternative embodiment 100 has housing with a front section 102 and back section 104 that interlock together, like the housing 12 of the preferred embodiment 10. The alternative embodiment 100 housing also contains a bladder with a sealed filling port. However the bladder in this configuration has a dispensing hose 106 with a dispensing eyepiece 108 connected thereto. Like the preferred embodiment 10, the alternative embodiment 100 may also include an internal platen for applying pressure to the bladder. The platen is forced downward by pulling on a number of straps 110 that are connected to the platen. The straps 110 have looped ends 112 to facilitate applying pressure to the bladder. In all other respects, the alternative embodiment 100 is the same as the preferred embodiment 10.

Therefore, it can be seen that the present invention provides a unique and improved alternative to the prior art by providing a cartridge assembly having a rigid plastic housing that firmly holds a dispensing spout of a flexible bag in place.

It would be appreciated by those skilled in the art that various changes and modifications can be made to the illustrated embodiments without departing from the spirit of the present invention. All such modifications and changes are intended to be within the scope of the present invention, except insofar as limited by the appended claims.

What is claimed is:

1. A cartridge for an emergency eyewash stations, comprising:

a housing, said housing having a front section and a back section that couple together, said front section having a surface defining an opening into said housing;

a sealed, fluid-containing bladder contained within said housing, said badder having a dispensing port thereon;

a bracket configured and arrange to couple to said opening on said front section wherein said dispensing port is captured in a fixed position between said bracket and said surface defining said opening;

a platen positioned within said housing and adjacent to said bladder, said platen freely movable between an upper position wherein said bladder is uncompressed and a lower position wherein said bladder is compressed; and at least one strap connected to said platen;

said at least one strap configured and arranged to be drawn out from said housing thereby moving said platen from said upper uncompressed position to said lower compressed position thereby compressing said bladder with said platen when said emergency eyewash station is activated.

2. The cartridge assembly of claim 1, wherein there are two straps.

3. The cartridge assembly of claim 1, wherein the housing further includes hanging brackets extending therefrom to permit said housing to be hung.

4. The cartridge assembly of claim 1, wherein said bracket further comprises:

a semi-circular shaped lip; and a pair of mounting tabs;

said surface defining said opening and said semi-circular lip defining a circular orifice configured to capture said dispensing port therebetween.

5. The cartridge assembly of claim 1, wherein said front section and said back section housing snap-fit together.

6. The cartridge assembly of claim 1, wherein said front section of said housing further includes an outwardly-turned first rim; and said back section of said housing further includes an outwardly-turned second rim.

7. The cartridge assembly of claim 6, wherein said first rim further includes a plurality of first mating formations aligned along said first rim; and said second rim further includes a plurality of second mating formations aligned along said second rim;

said first mating formations and said second mating formations being reciprocal to one another respectively and configured to interlock and hold together said front section and said back section to keep said housing in an assembled relation.

8. The cartridge assembly of claim 1, where said front section and said back section are identical.

* * * * *